United States Patent [19]

Aiken, Sr.

[11] Patent Number: 4,995,183

[45] Date of Patent: Feb. 26, 1991

[54] SCROLLING SIGN WITH IMPROVED WEB GUIDE

[76] Inventor: Robert B. Aiken, Sr., 1970 Bobolink Avenue, Grafton, Wis. 53024

[21] Appl. No.: 160,791

[22] Filed: Feb. 26, 1988

[51] Int. Cl.[5] ..... G09F 11/18

[52] U.S. Cl. ..... 40/518; 40/471

[58] Field of Search ..... 40/518, 519, 471, 520, 40/521, 522, 523

[56] References Cited

U.S. PATENT DOCUMENTS

| | | | |
|---|---|---|---|
| 133,236 | 11/1972 | Lyon et al. | 40/518 |
| 279,504 | 6/1883 | Sanderson et al. | 40/518 |
| 1,821,844 | 7/1929 | McGrath | 40/471 |
| 2,419,802 | 4/1944 | Van Horne | 40/471 |
| 2,722,069 | 9/1950 | Overbeek | 40/471 |
| 3,255,541 | 6/1966 | Bettcher | 40/471 |
| 4,680,883 | 7/1987 | Standjuhar | 40/471 |
| 4,741,118 | 5/1988 | Aiken et al. | 40/518 |

*Primary Examiner*—Laurie K. Cranmer
*Assistant Examiner*—J. Bonifanti
*Attorney, Agent, or Firm*—Andrus, Sceales, Starke & Sawall

[57] ABSTRACT

An improved guide means suitable for use in a scrolling sign having an internal frame work and a sign face with a window in which indicia may appear. A web containing serial indicia is wound on web rolls. The web extends along a path between the web rolls and across the window for selectively displaying indicia on the window as the web is unwound and rewound on the rolls by a motor. The guide means includes a pair of plate-like guide members lying normal to the path of the web and spaced along the path. The guide members receive the web, at least along their edges so that the web extends between the guide members and across the window in the sign face and may contain baffles to eliminate light leaks. The guide members may be formed of translucent or transparent material to avoid shadows on the sign face. A brace member and adjustment bar may extend between the guide members. The guide members are fastened to plates lying at either end of the guide members having mounts for mounting the plates to the frame work of the sign. The web rolls may also be mounted in the plates so that the guide members, web rolls and plates form a module that can be installed in, and removed from, the sign as a unit.

18 Claims, 2 Drawing Sheets

SCROLLING SIGN WITH IMPROVED WEB GUIDE

The present invention relates to a sign of the type in which indicia are changed by scrolling a web containing same across one or more viewing windows in the sign. The invention relates, more particularly, to a guide means for guiding the web during its scrolling movement in the sign.

It is an object of the present invention to provide an improved guide means that facilitates the scrolling movement of the web in the sign and registry of the indicia in the windows of the sign.

It is a further object of the present invention to provide such a web guide means that is especially suited for scrolling signs of the back-lit type in that it avoids shadows on the translucent sign face through which the light shines. The web guide means further avoids light leaks on the face of the face of the sign.

Another object of the present invention is to provide a web guide means that permits the elimination of idler rolls and the like, if desired.

Yet another object of the present invention is to provide a web guide means that can be positioned in the sign independently of other web handling elements, such as web rolls. This facilitates the accommodation of other elements in the sign, such as lights.

A still further object of the present invention is to provide a web guide means that can be incorporated with the web and web rolls in a removable module. This thereby facilitates assembly of the sign. It also simplifies repair and maintenance of the sign, since a module can be removed and replaced as a unit.

The web guide means is compact in construction and is suitable for use in a wide variety of signs and permits the retrofitting of existing signs.

The foregoing and other objects will be more fully understood from the following description of the invention.

Briefly, the improved guide means of the present invention is suitable for use in a scrolling sign of the type having a sign face with a window in which indicia may appear. A web containing serial indicia is wound on web rolls. The web extends along a path between the web rolls and across the window for selectively displaying indicia in the window as the web is unwound and rewound on the rolls when the rolls are selectively driven by a motor.

The guide means includes a pair of plate-like members. The plate-like members lie generally normal to the path of the web and are spaced along the path. The members receive the web, along at least one edge of each of the members, so that the web extends between the members. Means are provided for mounting the members on the frame work of the sign so that the members position the web across the window in the sign face. Projections may be provided on the members that extend toward the sign face so as to prevent the inside of the sign face from striking the web should the sign face be deflected by wind. A brace may extend between the plate-like members to form the members into a unitary guide means structure. The plate-like members and brace may be formed of translucent or transparent material so as to reduce or eliminate shadowing on the sign face. Baffles may be provided on the plate-like members to eliminate or reduce light leaks on the sign face.

One or more adjusting bars may also extend between the plate-like members to assist the members in resisting the forces generated by the tension in the web.

The mounting means for the plate-like members may comprise further plates lying at either end of the guide members and fastened to the members and brace. The plates having means for securing the plates to the frame work of the sign. The plate-like members and brace may be fastened to the plates by inserting a metallic or other insert in the member or brace for receiving a threaded fastener extending through one of the plates and the plate-like member or brace. The plate-like members and brace may be mounted to each other in a similar fashion.

The web rolls may also be mounted in the plates so that the web rolls, plates, and plate-like members form a modular structure.

In the drawings employed in the following detailed description of the invention:

While the present invention is described below in the context of a sign for indicating the price of a product, such as gasoline, it will be appreciated that the invention is not so limited. The invention may be employed in signs providing alphabetical or numeric information in a wide range of applications.

Figure 1:
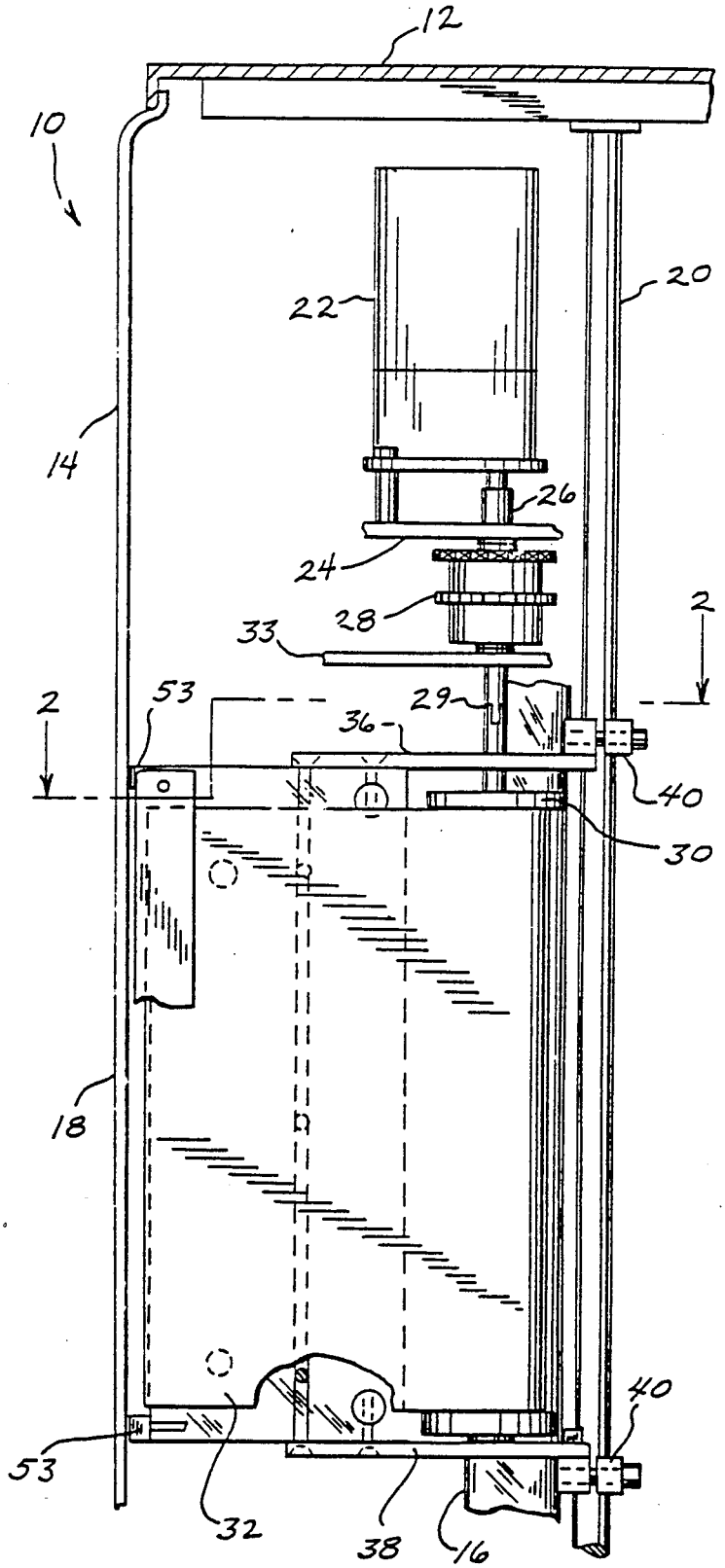
FIG. 1 is a cross sectional view through a scrolling sign incorporating the improved web guide means of the present invention.

FIG. 1 shows a scrolling sign 10. Sign 10 has a peripheral frame 12, a portion of which is shown in the figure. Sign face 14 may be formed of translucent material, such as plastic, that is vacuum formed to a bulging configuration. Lights, such as fluorescent lamp tubes 16, are provided in the interior of sign 10 for backlighting the sign through translucent face 14. Face of 14 may contain window area 18 through which the pricing or other indicia may appear.

A plurality of horizontally spaced rods 20 connected to frame 12 extend through the sign for providing a frame work for the scrolling mechanism and the web guide means of the present invention. Motor 22 may be mounted to rods 20 by bracket 24 containing fastening means not shown. The output shaft 26 of motor 22 is connected through drive means, such as a chain and sprocket drive 28 and coupler 29, to web rolls 30 for web 32. The drive means is mounted on rods 20 by bracket 33 containing fastening means, not shown.

Figure 2:
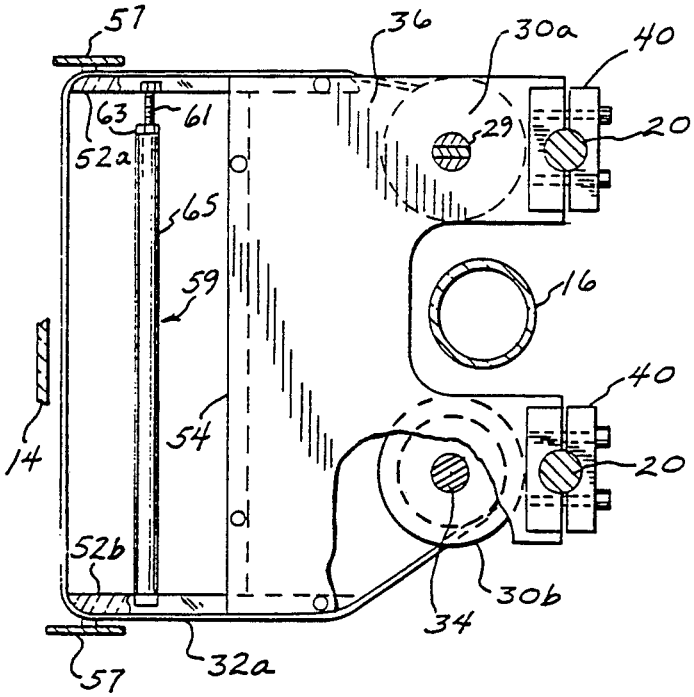
FIG. 2 is a cross sectional view taken along the line 2—2 of FIG. 1.
Figure 3:
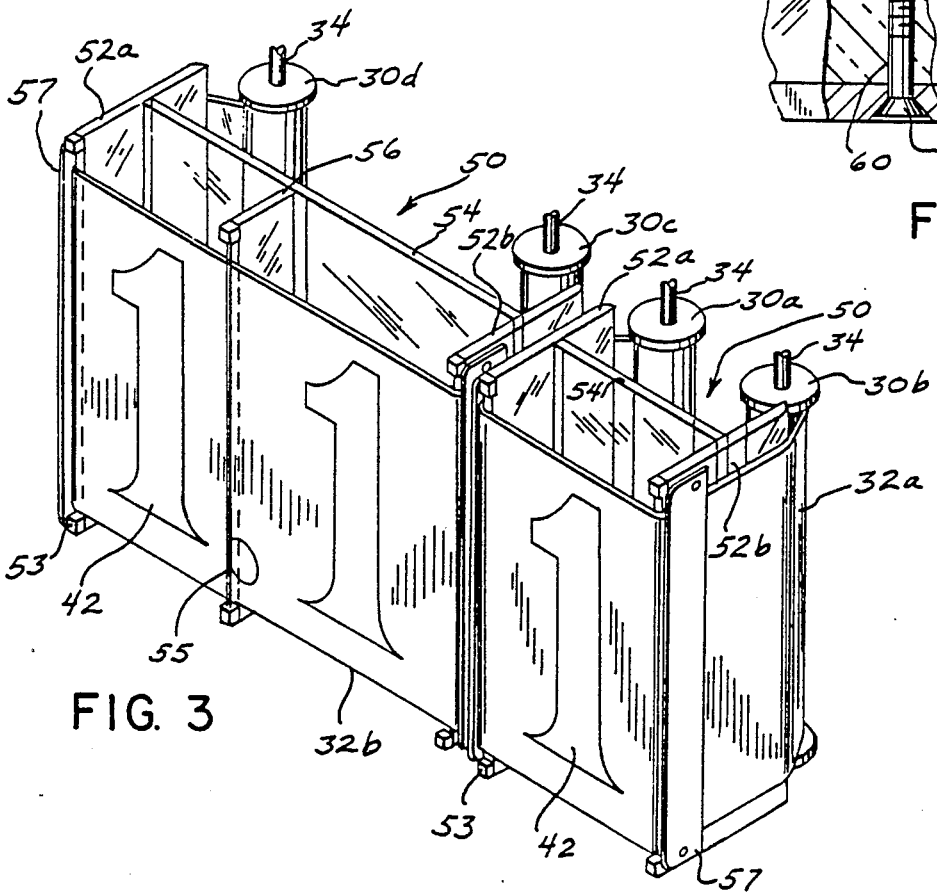
FIG. 3 is a partial perspective view showing the web guide means of the present invention.

The configuration of web rolls 30 and web 32 may be more clearly seen from FIGS. 2 and 3. Specifically, and as shown in FIG. 3, web **32*a* extends between web rolls 30*a* and 30*b*. Web 32*b* extends between web rolls 30*c* and 30*d*. In the embodiment of the invention shown in FIG. 3, sign 10 displays pricing information for a product, such as gasoline. Web 32*b* contains the dollar and dime indicia and web 32*a*** contains the cents indicium. It will be appreciated that other arrangements of indicia on the webs may be utilized.

Webs **32*a* and 32*b* are scrolled in sign 10 by unwinding the web from one web roll and winding up the web on the other web roll. Selectively energizable clutches may be incorporated in the drive means for energizing one or the other of the web rolls of each pair 30*a*–30*b* or 30*c*–30*d***. Details of design considerations for the drive mechanism and other aspects of the scrolling sign are further described in U.S. patent application Ser. No. 871,072, filed June 5, 1986, now U.S. Pat. No. 4,741,118.

Web rolls 30 are supported by shafts 34, journaled in upper plate 36 and lower plate 38. Plates 36 and 38 are mounted on rods 20 by clamping brackets 40.

Web 32 is typically formed of a clear base material with a translucent, colored background coating that is, preferably, the same color as translucent sign face 14. The indicia 42 on web 32 are typically formed in a translucent color that contrasts to that of the background. Depending on the desired graphic effect, the indicia may be lighter or darker than the background, or may be opaque.

The improved guide means 50 of the present invention includes a pair of spaced, plate-like members 52*a* and 52*b*. When web 32 moves in a horizontal path between web rolls 30, members 52 have a vertical orientation. The vertical edges of members 52 may be rounded to facilitate passage of web 32, as shown in FIG. 2. Depending on the material comprising members 52 and web 32, it may be desirable to provide a friction reducing treatment to the edges of the guide members. A low friction coating or film may be applied to the edges. For example, a tetrafluoroethylene or high density polyethylene tape may be applied to the edges of the members. Or, a friction reducing substance may be incorporated in the material of the members.

As shown in the Figures, projections or bumpers 53 may be provided at the upper and lower edges of members 52 proximate the interior of sign face 14 to prevent the inner surface of sign face 14 from striking and scratching web 32 in the event the sign face is deflected inwardly by wind. Bumpers 53 also prevent adherence between the sign and web under conditions of extreme heat or cold. Bumpers 53 may be formed of rubber or other soft material having stems that are inserted in holes in members 52.

Brace member 54 extends between vertical members 52 to form these elements into a guide means assembly. Guide means 50 for web 32*a* may contain vertical member 56 intermediate members 52 for supporting web 32*b* in the span between members 52. Vertical member 56 has retainer 55 extending between bumpers 53 to keep web 32*a* off sign face 14 and avoid light leaks should the web curl in the span between members 52. Retainer 55 may be formed of any suitable material, such as a length of monofilament line extending between the bumpers.

Guide means 50 may include baffles 57 that eliminate and reduce light leaks along the edges of windows 18 for web 32. Baffles 57 may be spaced from members 52 by an amount sufficient to allow web 32 to pass between the baffle and the members.

As shown in FIGS. 1 and 2, one or more adjustable length bars 59 may extend between members 52 to assist the members in resisting the forces on them generated by the tension in the web. Adjustment of bars 59 assists in maintaining members 52 parallel or permits such alteration as is necessary to obtain proper movement and positioning of the web in the sign. Two bars 59 are shown in FIGS. 1 and 2. The ends of the bars are countersunk into members 52. Adjustment in the length is provided by threaded portion 61 and nut 63. Threaded portion 61 extends into portion 65. Bars 59 are sufficiently small as to avoid shadows on the web or sign face.

Figure 4:
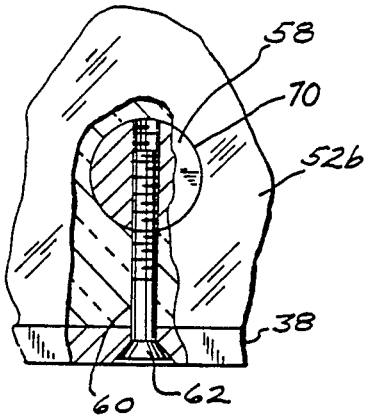
FIG. 4 is a fragmentary, detailed side view showing a fastening means incorporated in the web guide means.

Web guide means 50 is affixed to upper and lower plates 36 and 38 as by fastening the members 52 to the plates. Brace 54 may also be fastened to plates 36 and 38. To provides a high strength mounting, the mounting may be carried out in the manner shown in FIG. 4. Hole 70 is drilled through vertical member 52*b*. Metal plug 58 is inserted in hole 70. A second hole, transverse to hole 60, is drilled through plate 38, edge wise through vertical member 52*b*, and into metal plug 58. Metal plug 58 is tapped to provide threads. Bolt 62 is inserted through hole 60 and screwed into metal plug 58 to secure web guide means 50 to plate 38. Plate-like members 52 and brace 54 may be joined together in a similar manner.

Web guide means 50, including vertical plate-like members 52 and brace 54 may be made of a transparent material, for example, polycarbonate, or other plastic, or glass that allows light from lamps 16 to evenly illuminate web 32 and sign face 14. This provides the highly significant advantage of avoiding shadows on the sign face. The web guide means is supported on plates 36 and 38 away from sign face 14 for a similar purpose.

As seen in FIGS. 2 and 3, webs 32 travels from one of the web rolls around one member 52 across sign face 14 in alignment with window 18, around the other vertical member 52 and onto the other web roll. The web passes over the rounded front edges of members 52 adjacent sign face 14. In the embodiment of the invention illustrated in the drawing, web 32 also passes along the sides of the members and coacts with the rear edges of the members.

Guide means 50 avoids the use of idler rolls in guiding web 32. Such idler rolls, either translucent or opaque, can cause shadows or act as prisms in back lit signs, causing uneven lighting of the sign face.

It will be appreciated that web guide means 50 controls the positioning of web 32 in window 18 on sign face 14. Web rolls 30 may thus be placed wherever convenient in the sign enclosure. This separation of the web positioning function performed by web guide means 50 from the web transport and storage function performed by web rolls 30 facilitates placement of the scrolling mechanisms in sign enclosures, since lamps 16 may be easily accommodated. Thus, rolls 30 may be placed in sign 10 at locations that reduce, or eliminate, shadowing of sign face 14, such as between lamps 16 as shown in FIG. 2. The aforesaid separation also facilitates retrofitting existing sign enclosures.

While providing such flexibility, web guide means 50 also lends itself to incorporation in a module that can be removed from, and replaced in, sign 10 as a unit. Members 52 and brace 54 are joined together into an integral structure, as by the means shown in FIG. 4. The members and brace are fastened to plates 36 and 38. Web rolls 30 are also journalled in plates 36 and 38. By undoing clamping brackets 40 of plates 36 and 38, and separating coupling 29, the members, plates, and web rolls may be removed from sign 10 as a unit or module. The module may be installed in the unit in an analogous manner. This facilitates assembly and repair of sign 10. Coupler 29 may have the tongue and groove configuration shown in FIGS. 1 and 2 to render the coupling easily separable. The tongue and groove are aligned in the manner shown in FIG. 2 to permit the module to be removed or installed in sign 10.

While described in the foregoing in the context of a back lit sign, it will be appreciated that the guide means of the present invention is equally suited to signs of the front lit or non-illuminated type.

Various modes of carrying out the invention are contemplated as being within the scope of the following claims particularly pointing out and distinctly claiming the subject matter which is regarded as the invention.

I claim:

1. An improved guide means for a scrolling sign having a framework and a sign face with a window in which indicia may appear, a pair of rotatable web rolls with a web containing serially arranged indicia wound thereon, said web extending along a path between the web rolls and across the window for selectively displaying indicia in the window, said guide means comprising:

a pair of plate-like members, said members lying along the path of the web and spaced from each other along the path, said members receiving the web, at least along an edge of each of said members, said web extending between said members from one member of said pair to the other member of said pair, said members lying parallel to each other and generally normal to the portion of the web extending between said members;

brace means mounted to and extending between said plate-like members for joining said members into a unitary structure, said brace means extending between said plate-like members at a location removed from said edges of said plate-like members receiving the web so that the portions of said members containing said edges receiving said web are cantilevered beyond said brace means, adjustable length means extending between said cantilevered portions of said plate-like members, said adjustable length means establishing the distance between said plate-like members in a direction parallel to the path of the web; and means suitable for mounting said unitary structure containing said plate-like members on said framework so that said guide means positions the portion of the web extending between said members across the window.

2. The improved guide means according to claim 1 wherein said edges of said members receiving the web are rounded.

3. The improved guide means according to claim 1 wherein, at least, said edges of said members includes means for reducing friction between the web and the members.

4. The improved guide means according to claim 1 wherein said guide means is formed of light transmitting material.

5. The improved guide means according to claim 4 wherein said guide means is formed of transparent material.

6. The improved guide means according to claim 1 wherein said members contain projections extending from said members beyond the web when the web is received on the members.

7. The improved guide means according to claim 1 wherein said members contain light baffles proximate the edges of said members receiving the web, said baffles being spaced from said members so that the web can pass between said members and baffles.

8. The improved guide means according to claim 1 including a further plate-like member mounted on said brace intermediate said pair of plate-like members for supporting the web between said pair of members.

9. The improved guide means according to claim 8 further including a retainer means for said web mounted on said further plate-like member.

10. The improved guide means according to claim 1 including a pair of plates lying normal to said pair of members at either end thereof, said members being fastened to said plates, wherein said web rolls are mounted on said plates, whereby said pair of members, web rolls, web, and plates comprise a modular structure mountable in said sign.

11. The improved guide means according to claim 10 wherein said members contain inserts for receiving fasteners extending through said plates for fastening said members to said plates.

12. In combination, a scrolling sign having a framework and a sign face with a window in which indicia may appear, a pair of rotatable web rolls with a web containing serially arranged indicia wound thereon, said web extending along a path between the web rolls and across the window for selectively displaying indicia in the window, and a guide means for said web, said guide means comprising: a pair of plate-like members, said members lying along the path of the web and spaced from each other along the path, said members receiving the web, at least along an edge of each of said members, said web extending between said members from one member of said pair to the other member of said pair, said members lying parallel to each other and generally normal to the portion of the web extending between said members; brace means mounted to and extending between said plate-like members for joining said members into a unitary structure, said brace means extending between said plate-like members at a location removed from said edges of said plate-like members receiving the web so that the portions of said members containing said edges receiving said web are cantilevered beyond said brace means, adjustable length means extending between said cantilevered portions of said plate-like members, said adjustable length means establishing the distance between said plate-like members in a direction parallel to the path of the web; and means suitable for mounting said unitary structure containing said plate-like members on said framework so that said guide means positions the portion of the web extending between said members across the window.

13. The combination according to claim 12 wherein said guide means is formed of light transmitting material.

14. The combination according to claim 12 wherein said members contain projections extending from said members beyond the web when the web is received on the members.

15. The combination according to claim 12 wherein said members contain light baffles proximate the edges of said members receiving the web, said baffles being spaced from said members so that the web can pass between said members and baffles.

16. The combination according to claim 12 including a further plate-like member extending from said brace intermediate said pair of plate-like members for supporting the web between said pair of members.

17. The combination according to claim 16 further including a retainer means for said web mounted on said further plate-like member.

18. The combination according to claim 12 including a pair of plates lying normal to said pair of members at either end thereof, said members being fastened to said plates, said plates containing means for mounting said guide means to said framework.

* * * * *